US007014600B2

(12) United States Patent
Johnson

(10) Patent No.: US 7,014,600 B2
(45) Date of Patent: Mar. 21, 2006

(54) OVERHEAD ADJUSTABLE RESISTANCE EXERCISE MACHINE

(76) Inventor: David O. Johnson, 9912 Brookside Ave., Bloomington, MN (US) 55431

( * ) Notice: Subject to any disclaimer, the term of this patent is extended or adjusted under 35 U.S.C. 154(b) by 178 days.

(21) Appl. No.: 10/371,872

(22) Filed: Feb. 21, 2003

(65) Prior Publication Data

US 2003/0158020 A1 Aug. 21, 2003

Related U.S. Application Data

(60) Provisional application No. 60/359,175, filed on Feb. 21, 2002.

(51) Int. Cl.
*A63B 26/00* (2006.01)

(52) U.S. Cl. ..... 482/140; 482/69; 482/92

(58) Field of Classification Search ..... 482/69, 482/92, 93, 94, 95, 140
See application file for complete search history.

(56) References Cited

U.S. PATENT DOCUMENTS 4,296,924 A * 10/1981 Anzaldua et al. ..... 482/139
4,893,811 A * 1/1990 Dilmore ..... 482/5
5,924,965 A * 7/1999 Vardy ..... 482/112
6,174,270 B1 * 1/2001 Dagenais ..... 482/148
6,348,028 B1 * 2/2002 Cragg ..... 482/148
6,551,214 B1 * 4/2003 Taimela ..... 482/10
2001/0027149 A1 * 10/2001 Bingham
2003/0166441 A1 * 9/2003 Kerry

* cited by examiner

*Primary Examiner*—Gregory L. Huson
*Assistant Examiner*—L. Amerson

(57) ABSTRACT

An overhead exercise system for a complete, low impact, upper body workout emphasizes strengthening and toning the abdominal and oblique muscle groups of the human body. The system simulates an Olympic hammer throw by using adjustable resistance, such as adjustable hydraulic pressure. The system can be used in a number of positions including standing and sitting positions. A rotatably mounted arm having a handle grip is moveable in clockwise and counterclockwise directions. Handle pressure is independently adjustable for clockwise and counterclockwise motion. A seat is adjustable both vertically and horizontally to accommodate the user.

19 Claims, 10 Drawing Sheets

OVERHEAD ADJUSTABLE RESISTANCE EXERCISE MACHINE

This appln. claims the benefit of 60/359,175, filed Feb. 21, 2002.

FIELD OF THE INVENTION

The invention relates to the field of exercise machines. The exercise machines provide overhead adjustable resistance for exercise of the upper body.

BACKGROUND OF THE INVENTION

Recently, there has been an increase in the use of weight training by men and women athletes. Top competitors in almost every sport commonly use weights to increase strength, muscular endurance and flexibility, and to facilitate recovery from injury. Weight training is one of the most versatile of all athletic activities. It can be used for a variety of purposes: general conditioning, bodybuilding, increasing strength, improving physical appearance, minimizing fat, strengthen weaknesses and preventing injuries. It is an excellent cornerstone for improved performance in almost every sport and can be a foundation in the development of good health. General conditioning programs enable a person to develop muscle tone, improve circulation, start building strength and endurance, start replacing body fat with muscle tissue, develop the capacity to work harder and mental well-being.

The abdominal muscle group is one of the major muscle groups of the human body. As the abdominal muscles become stronger, the stomach becomes flatter. Weight training is one of the fastest, easiest and best ways to improve shape, tone and strength of the abdominal muscles.

Isokinetic or equal speed resistance weight training exercise machines have been developed. These machines increase resistance throughout the exercise movement so that a person moves the maximum weight throughout the entire range of motion. Accommodating resistance machines provide resistance proportionate to the effort applied to it by the person using the machine.

Most modern health clubs, spas and gyms are equipped with universal-type multi-station machines. These multi-station universal gym machines have stations for exercising all the major muscle groups of the body. They are typically built of chrome-plated tubular steel pipe with an adjustable weight stack of 10 lbs to 500 lbs depending upon the body area to be exercised. The weight is adjusted by placing a selector pin at the desired poundage.

Isokinetic exercise machines, such as Nautilus machines, are used to exercise muscles of the body evenly throughout the complete range of motion. These machines provide accommodating resistance or perfectly balanced resistance that is constant throughout the entire range of motion, from full stretch to complete contraction. Throughout the entire movement, the resistance is automatically adjusted by an off-center cam, with the aim of maximum resistance throughout the range of motion. These machines provide variable resistance that is balanced to conform exactly to the normal strength curve of the working muscles.

Computerized weight-training machines are self-instructing, non-impact machines that have a set-up test to automatically determine the correct weight to use. The user programs the amount of time of the exercise and the degree of difficulty. The computer varies machine resistance to provide interval training. These machines provide negative resistance whereby the user not only lifts the weight up, but also must resist the weight as it move down.

SUMMARY OF THE INVENTION

The invention comprises an overhead resistance exercise machine useable to exercise the abdominal muscle group of the human body to improve shape, tone and strength of the abdomen. The exercise machine works the thin flat oblique muscles forming the middle and outer layers of the lateral walls of the abdomen. The concept of the machine is simple to understand and the machine is easy to use. Once the user becomes familiar with the machine, little or no supervision is required. The machine is safer than free weights since there is no risk of plates slipping off bars and no risk of being pinned by the weights. There are no weights to be removed from the machine minimizing disorganization and misplacement of weights. The user can change resistance rapidly by simply increasing the brake resistance. There are no plates to move, no pins to adjust thereby reducing risk of injury from falling weights or incorrect weight selection. The abdomen can be worked at numerous angles, as one can with free weights, by adjusting the height of the frame and by adjusting the lateral position of the overhead resistor.

DESCRIPTION OF PREFERRED EMBODIMENTS

Figure 1:
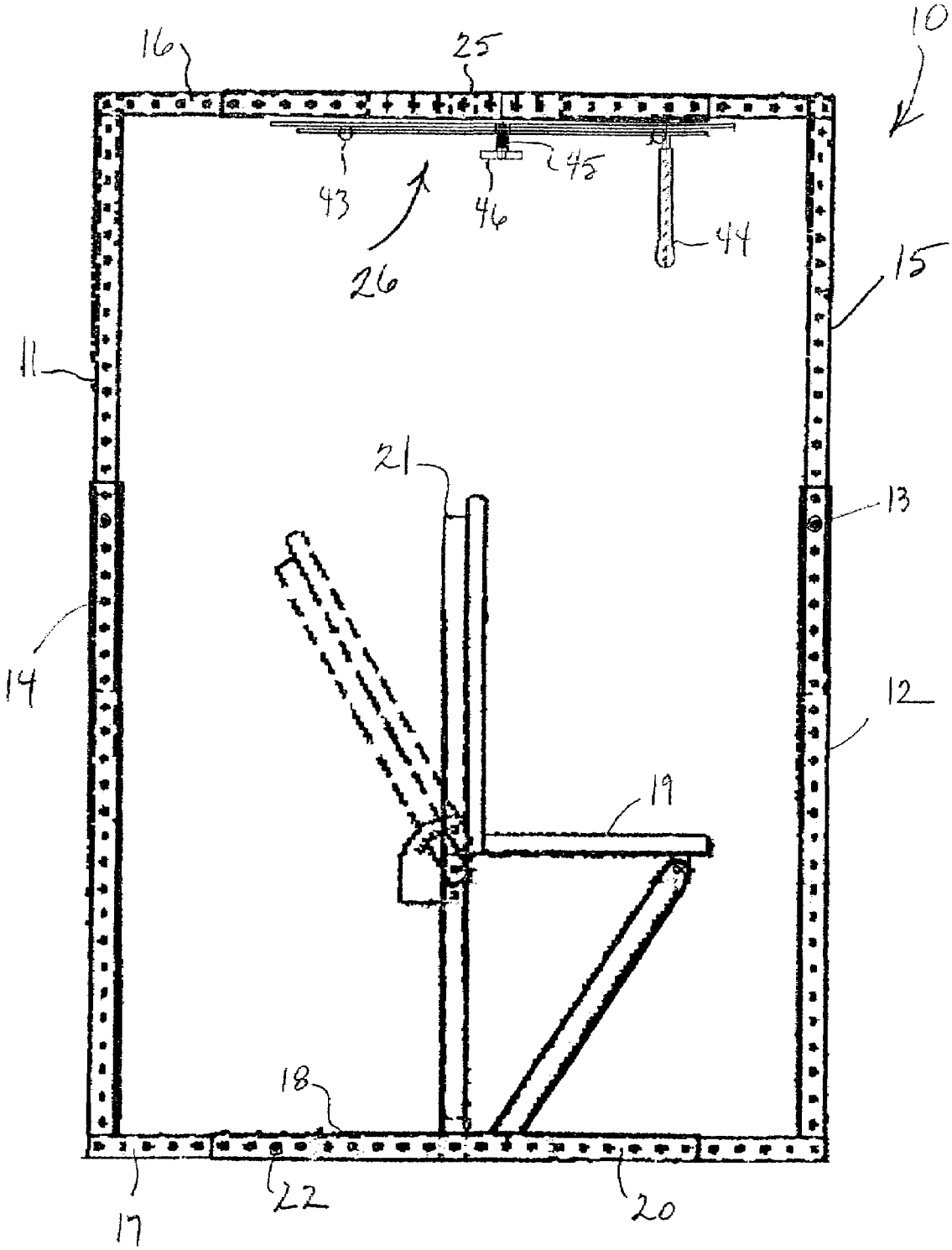
FIG. 1 is a side elevational view of an overhead adjustable resistance exercise machine of the invention.
Figure 2:
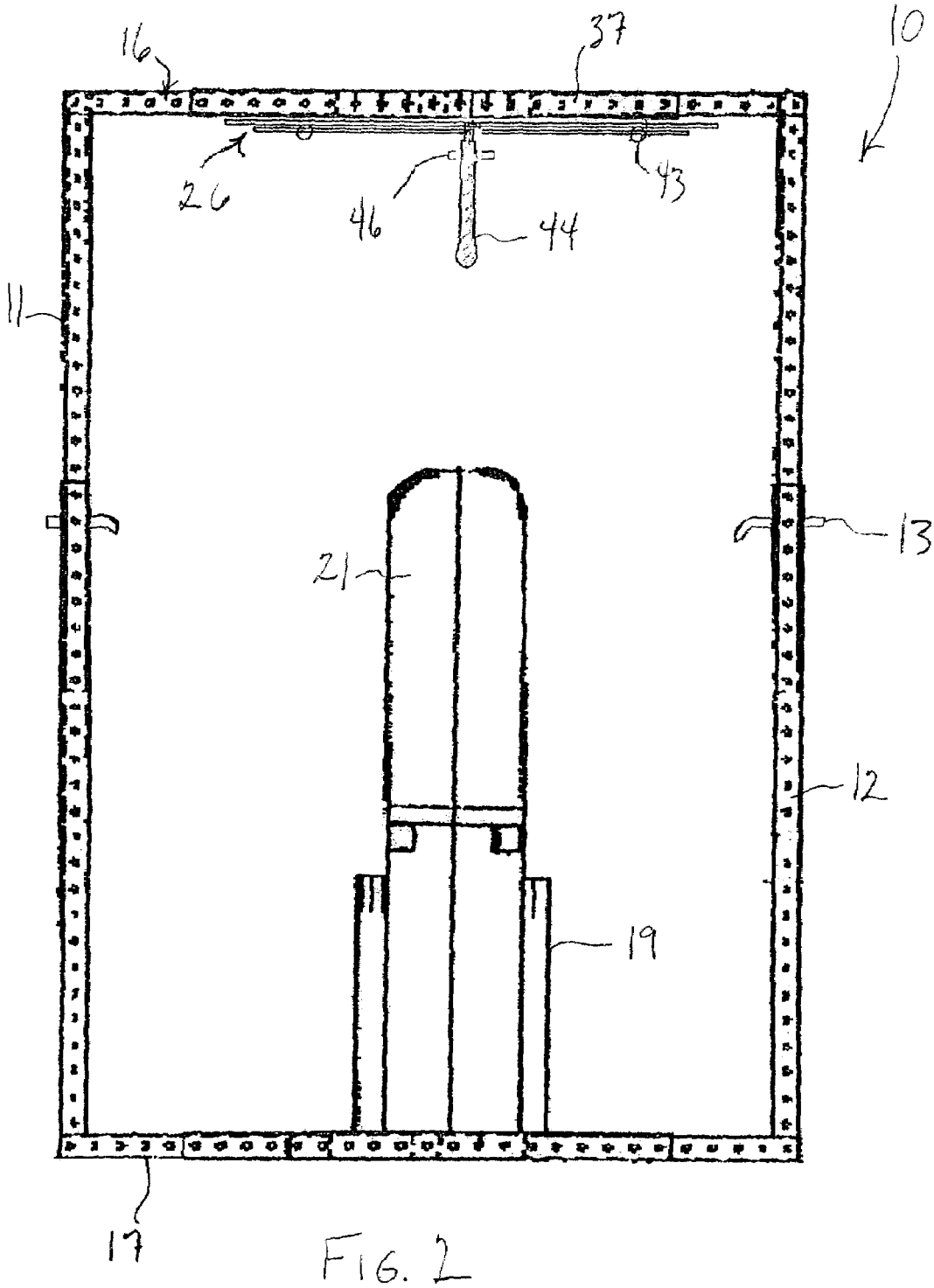
FIG. 2 is a front elevational view of FIG. 1.
Figure 3:
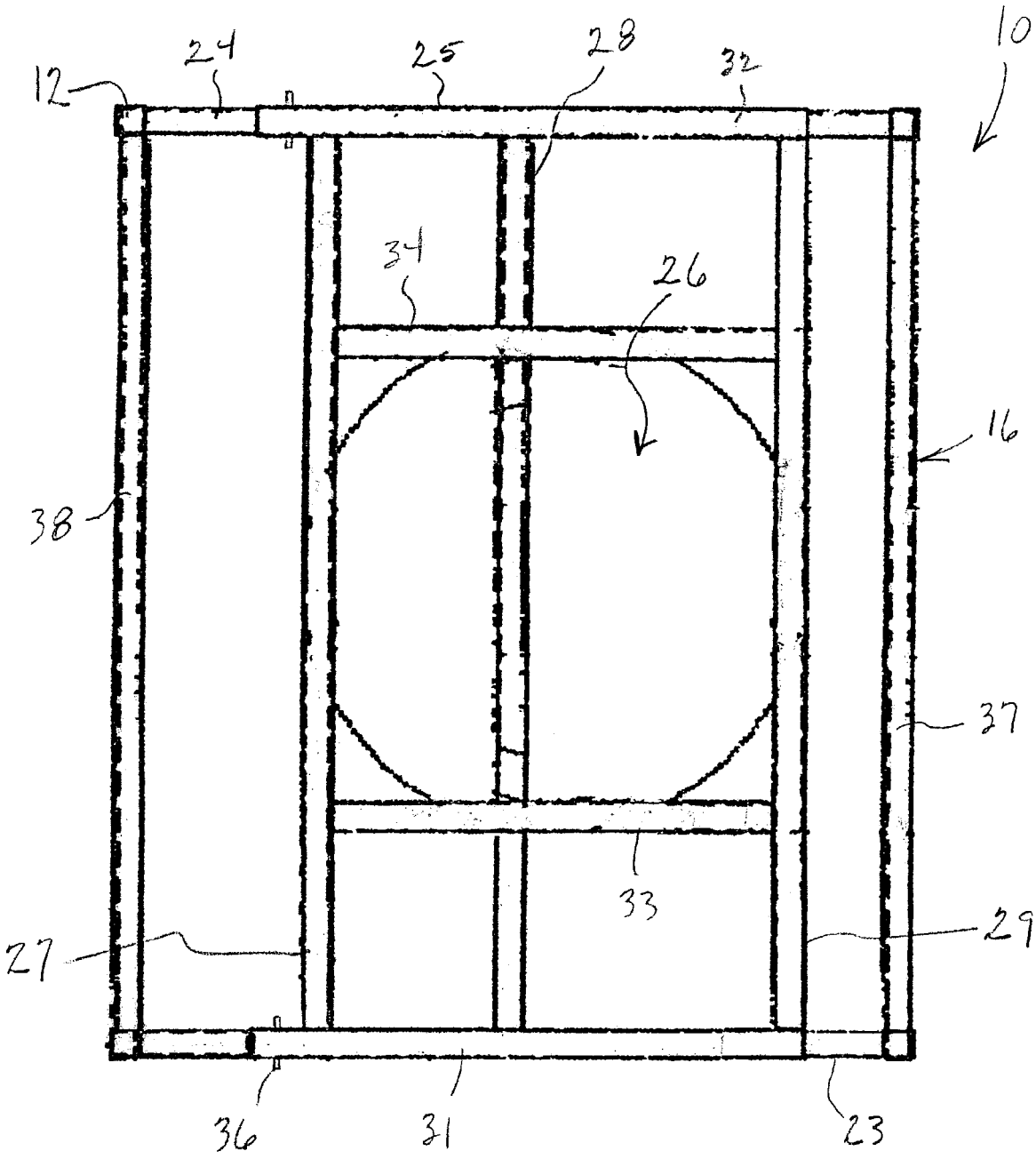
FIG. 3 is a top plan view of FIG. 1.

Referring to FIGS. 1 to 3, there is shown an overhead adjustable resistance exercise machine 10 of the invention. Exercise machine 10 is useable to exercise, condition and strengthen the thin flat oblique muscle that form the middle and outer layers of the lateral walls of the human abdomen as well as other muscles of the upper body and arms. Exercise machine 10 enables a person to develop abdominal muscle tone, improve circulation, building strength and endurance, prevent injuries, replace body fat with muscle tissue, develop the capacity to work harder and feel good. As the abdominal muscles become stronger, the stomach will become flatter thereby improving physical appearance. Other muscle groups of the human body can be exercised and conditioned with machine 10. Use of exercise machine 10 improves performance in a numerous sporting and recreational activities and can be a basis in the development of good health.

Machine 10 is a self-contained isotonic non-impact exercise machine having a generally rectangular or box-shaped frame 11 with a plurality of upright side support members 12 and 15. Support members 12 and 15 are telescopic tubing members which enable the height of frame 11 to be adjusted to adjust the vertical overhead position of resistance member 26 as desired. Pins 13 extending through holes 14 in the telescoping end sections of support members 12 and 15 maintain the selected height of frame 11.

Support members 15 are joined to a top frame assembly, indicated at 16. Support members 12 are joined to a bottom support member 17. Top frame assembly 16 has longitudinally extending tubular side members 23 and 24 connected to transverse end members 37 and 38. Bottom support member 17 is a rectangular shaped member having a generally flat bottom surface adapted to support exercise machine 10 on the surface of an exercise area, such as an exercise room in a hotel, office, health club, spa, gym and the like.

A rectangular platform 18 slidably mounted on bottom support member 17 supports a seat or chair 19 having an adjustable back rest 21. Back rest 21 is adjustable to an inclined position, as shown in broken lines in FIG. 1. Platform 18 has channel-shaped side walls 20 that slidably fit over the sides of bottom support member 17 to allow the platform 18 to be moved forwardly or rearwardly on bottom support member 17 to adjust the forward or rearward position of chair 19 as desired. A pin 22 extending through aligned holes in side wall 20 and bottom support member 17 hold platform 18 in its selected position.

An overhead adjustable rotary resistance member, indicated at 26, is slidably mounted on top frame assembly 16. As seen in FIG. 3, resistance member 26 is attached to a sub-frame assembly 25 having longitudinal members 27, 28 and 29 joined to end tubes 31 and 32. End tubes 31 and 32 telescope over tubular side members 23 and 24 of top frame assembly 16. Transverse support members 33 and 34 joined to the middle portions of longitudinal members 27 to 29 provide support and reinforce longitudinal members 27 to 29. End tubes 31 and 32 slide on side members 23 and 24 to allow forward and rearward movement of longitudinal members 27 to 29 to adjust the overhead position of longitudinal members 27 to 29 thereby adjusting the overhead position of resistance member 26. Pins 36 extending through holes in end tubes 31 and 32 and side members 23 and 24 hold resistance member 26 in its selected overhead position.

Figure 4:
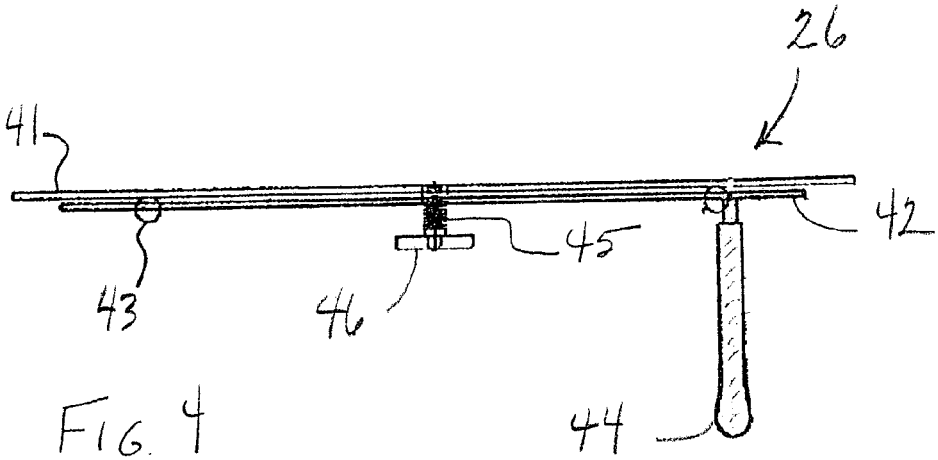
FIG. 4 is a side elevational view of the rotary resistance member of the exercise machine of FIG. 1.
Figure 5:
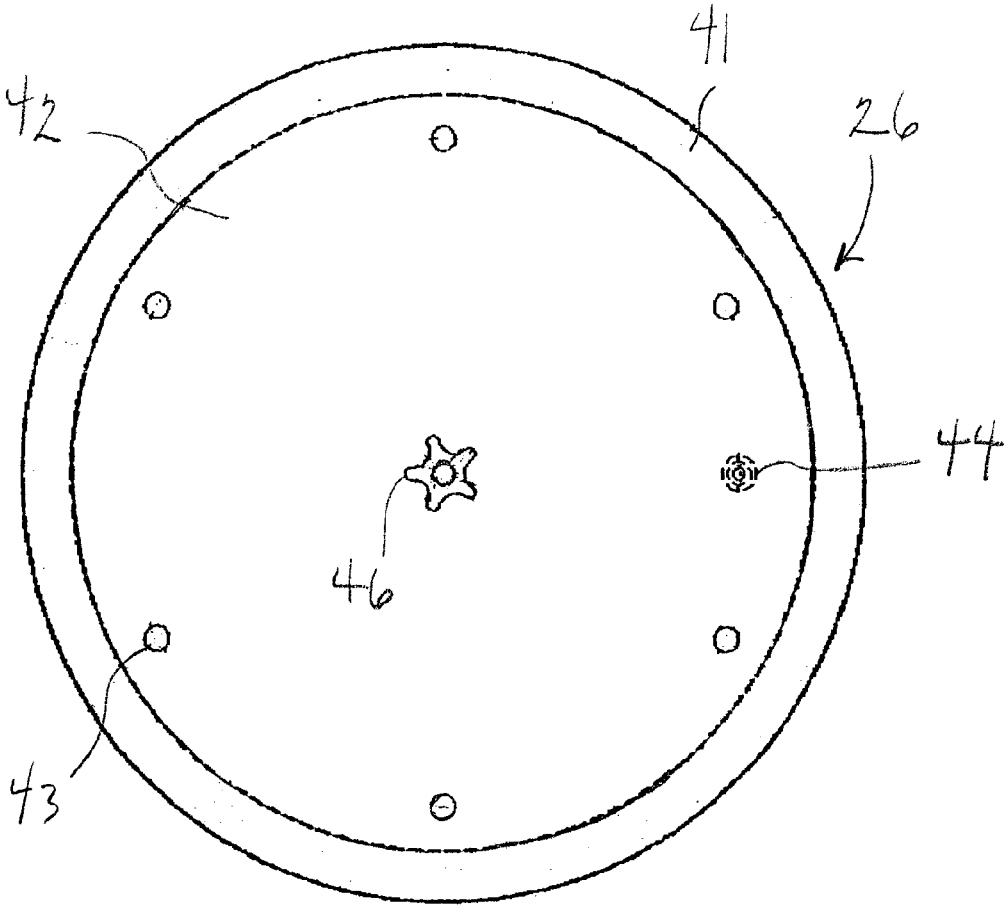
FIG. 5 is a bottom plan view of FIG. 4.

Referring to FIGS. 4 and 5, overhead adjustable rotary resistance member 26 is a wheel-shaped circular member having an upper support plate 41 attached to longitudinal members 27, 28 and 29 of sub-frame assembly 25. Plate 41 rotatably supports a lower wheel plate 42 concentric to upper support plate 41. A plurality of caged ball bearings 43 attached to lower wheel plate 42 rotatably mount wheel plate 42 on upper support plate 41. Bearings 43 are circumferentially spaced on outer portion of plate 42 at an equal distance and have a common radius with knob 46. The diameter of lower wheel plate 42 is slightly less than the diameter of upper support plate 41. Ball bearings 43 are located in an annular relation coaxial with the centers of plates 41 and 42.

A rotating grip handle 44 extending downwardly from the outer circumference of lower wheel plate 42 is used to rotate plate 42. Rotation of handle 44 in a forward or backward circular motion turns lower wheel plate 42 upon ball bearings 43 which roll on the bottom surface of upper support plate 41. Handle 44 can be gripped with one hand or both hands by a user.

Upper support plate 41 has a centrally located spring-loaded tension knob 46 which extends downwardly from upper support plate 41 through an opening in the center of lower wheel plate 42 to hold plates 41 and 42 in assembled relation. Knob 46 is moved toward plate 42 to increase the tension of a spring 45 thereby increasing the resistance of rotation of lower wheel plate 42 relative to upper support plate 41. Moving knob 46 outwardly from plate 42 decreases the tension of spring 45 thereby reducing the resistance of rotation of plate 42. There are no plates to move or pins to adjust to vary the machine resistance thereby reducing the risk of injury from falling weights or incorrect weight selection.

Exercise machine 10 can be used in connection with a bio feedback mechanism that records exercise results, such as the number of repetitions, the number of rotations per minute, the amount of time of the exercise and the degree of difficulty. The feedback mechanism displays or informs the user of the exercise results.

In use, the lateral position of chair 19 and the height of frame 11 are adjusted as desired. The incline of back rest 21 is selected. Sub-frame assembly 25 is moved laterally to adjust the lateral position of overhead resistance member 26. From a seated position in chair 19 user reaches up, grips handle 44 and rotates wheel plate 42 in a circular motion. The overhead resistance of resistance member 26 can be adjusted by turning knob 46 to increase or decrease the degree of difficulty of the overhead exercise machine 10 as desired. Operation of overhead adjustable rotary resistance member 26 simulates the athletic motion used in a track and field hammer throw event in which a weighted metal sphere attached to a flexible handle is rotated overhead prior to throwing the sphere for a distance. This overhead motion stimulates muscles of the body particularly the oblique muscles and other abdominal muscles providing a quick, efficient and effective way to improve shape, tone and strength of the abdomen for both female and male persons.

Figure 6:
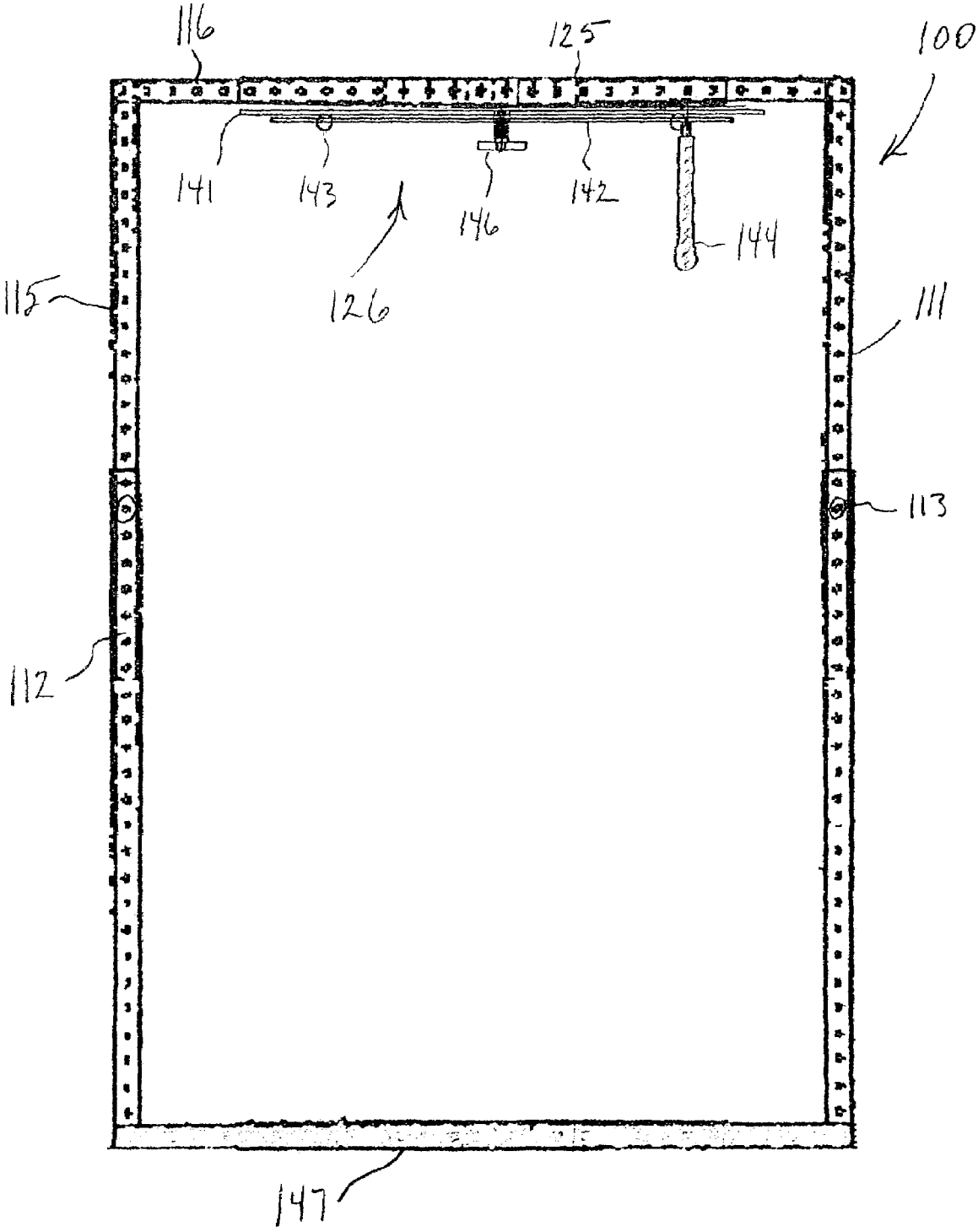
FIG. 6 is a side elevational view of a first modification of the overhead adjustable resistance exercise machine of FIG. 1.

A first modification of the exercise machine, indicated generally at 100, shown in FIG. 6, is an overhead variable resistance exercise machine operable from a standing position. The parts of exercise machine 100 that correspond to exercise machine 10 shown in FIGS. 1 to 5 have the same reference number with a prefix 1. Exercise machine 100 has a generally upright rectangular shaped frame 111 having a plurality of upright telescoping side support members 112 and 115. Pins 113 extending through holes in the overlapping ends of side support members 112 and 115 hold the members 112 and 115 together to maintain a selected height of frame 111. The height of frame 111 can be adjusted to adjust the vertical overhead position of resistance member 126.

Upper side support members 115 are connected to a top frame assembly 116 and lower side support members 112 are connected to a bottom support member 147. Top frame assembly 116 supports overhead rotary resistance member 126. Bottom support member 147 is a rectangular shaped transverse base or platform having generally flat top and bottom surfaces. The top surface of support member 147 is adapted to support a person operating exercise machine 100 from an upright standing position. The bottom surface of bottom support member 147 supports exercise machine 100 on the floor of an exercise area.

An overhead adjustable rotary resistance member 126 is connected to a sub-frame assembly 125 slidably mounted on top frame assembly 116. Resistance member 126 has an upper circular shaped support plate 141 rotatably supporting a lower concentric circular shaped wheel plate 142. Bearings 143 attached to lower plate 142 rotatably mount plate 142 to upper plate 141. A spring-loaded tension knob 146 holds plate 141 and 142 in assembled relation. Rotating knob 146 varies the resistance of rotation of lower plate 142 on upper plate 141 to increase and decrease the degree of difficulty of the exercised motion as desired.

Figure 7:
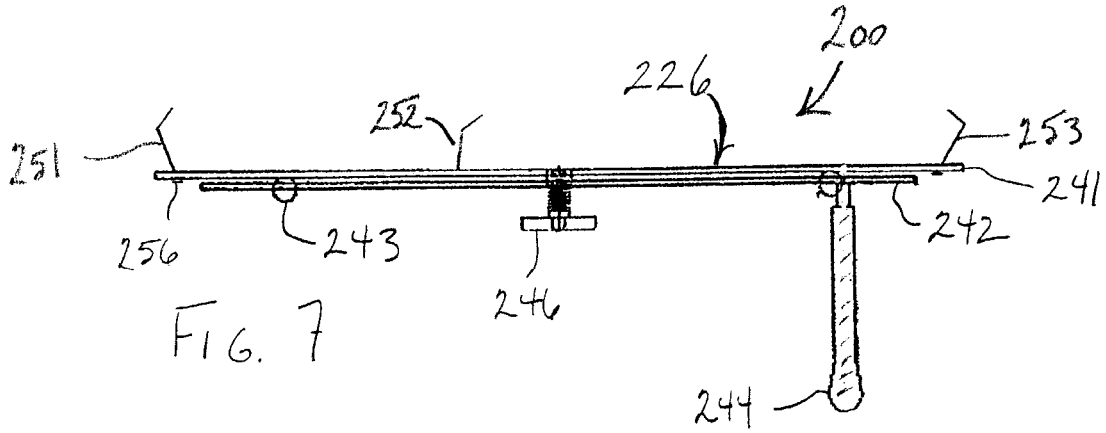
FIG. 7 is a side elevational view of a second modification of the overhead adjustable resistance exercise machine of FIG. 1.
Figure 8:
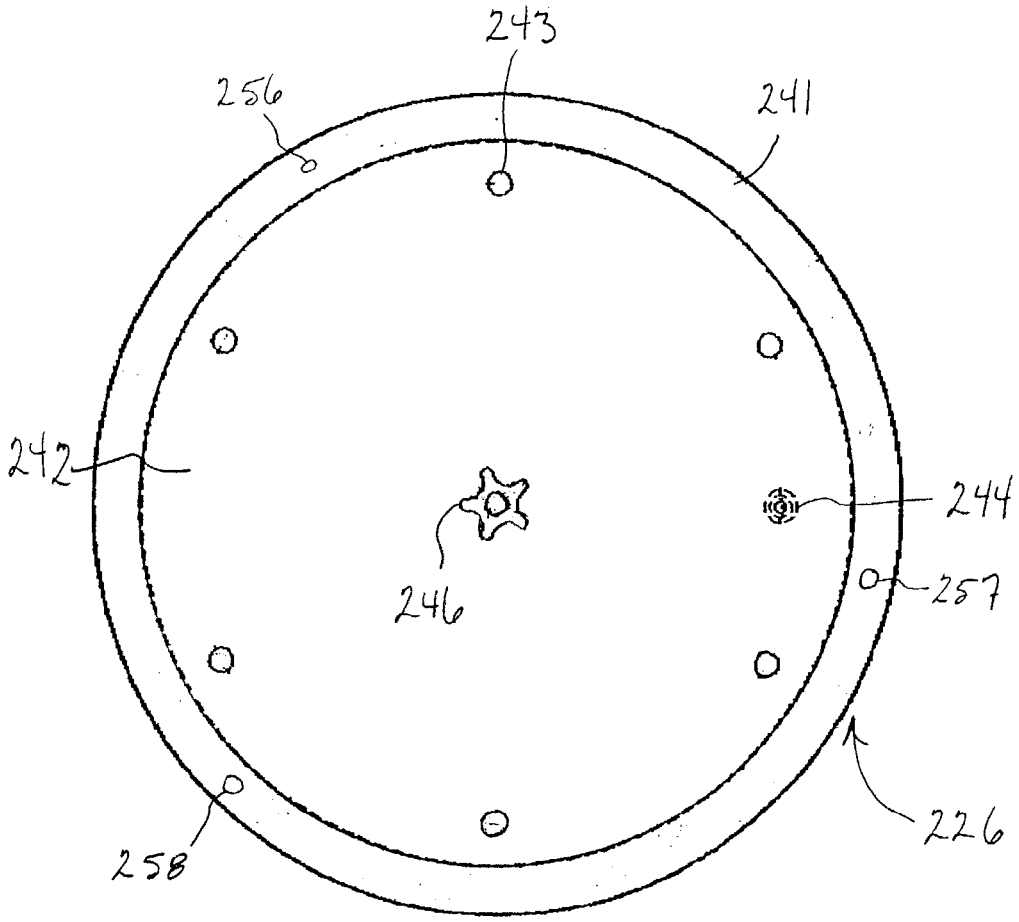
FIG. 8 is a bottom plan view of FIG. 7.

A second modification of the exercise machine, indicated generally at 200, shown in FIGS. 7 and 8, is an overhead variable resistance exercise machine adapted to be suspended from an overhead support, such as a ceiling, rafter, and the like. The parts of exercise machine 200 that correspond to exercise machine 10 shown in FIGS. 1 to 5 have the same reference numbers with a prefix 2.

Exercise machine 200 has a plurality of mounting brackets 251, 252 and 253 adapted to secure rotary resistance member 226 to an overhead support structure. The lower ends of brackets 251 to 253 extend through holes in upper support plate 241 and terminate in enlarged heads 256, 257 and 258 to retain the brackets 251 to 253 on plate 241. Brackets 251 to 253 are equally spaced around the outer circumference of plate 241 to hold resistance member 226 in a horizontal position relative to an overhead support. Brackets 251 to 253 are L-shaped hold-down support members having inwardly directed upper ends attachable to an overhead support. Other types of mounting brackets that are linearly aligned can be used to suspend resistance member 226 from horizontal overhead support structures, such as a door frame and the like. Brackets 251 to 253 fasten upper plate 241 in place whereby handle 244 can be used to rotate lower plate 242 on upper plate 241 with bearings 243. Spring-loaded tension knob 246 holding plates 241 and 242 in assembled relation is rotatable to adjust the resistance between plate 241 and 242 upon rotary movement of lower plate 241.

Figure 9:
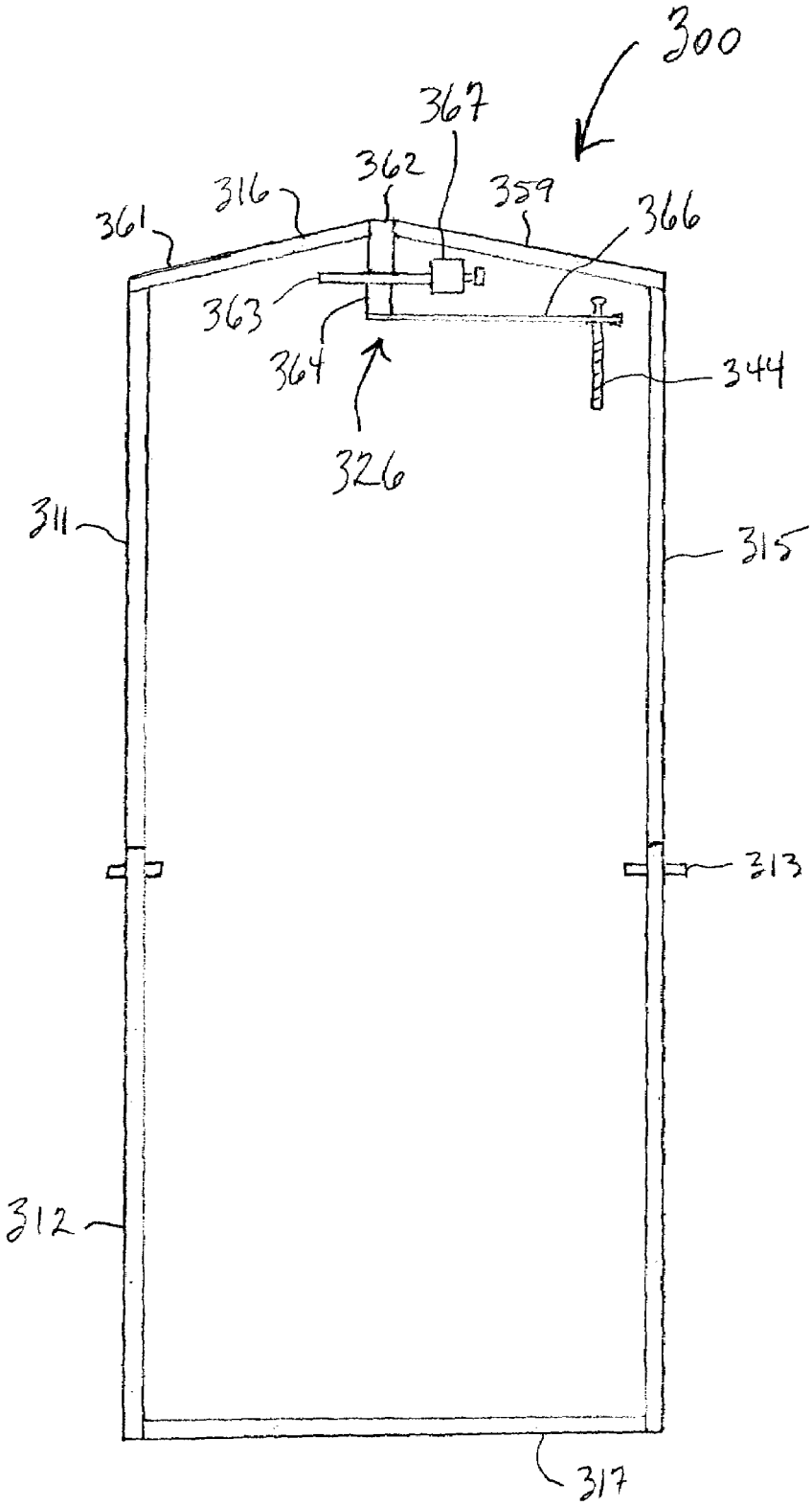
FIG. 9 is a front elevational view of a third modification of the exercise machine of FIG. 1.
Figure 10:
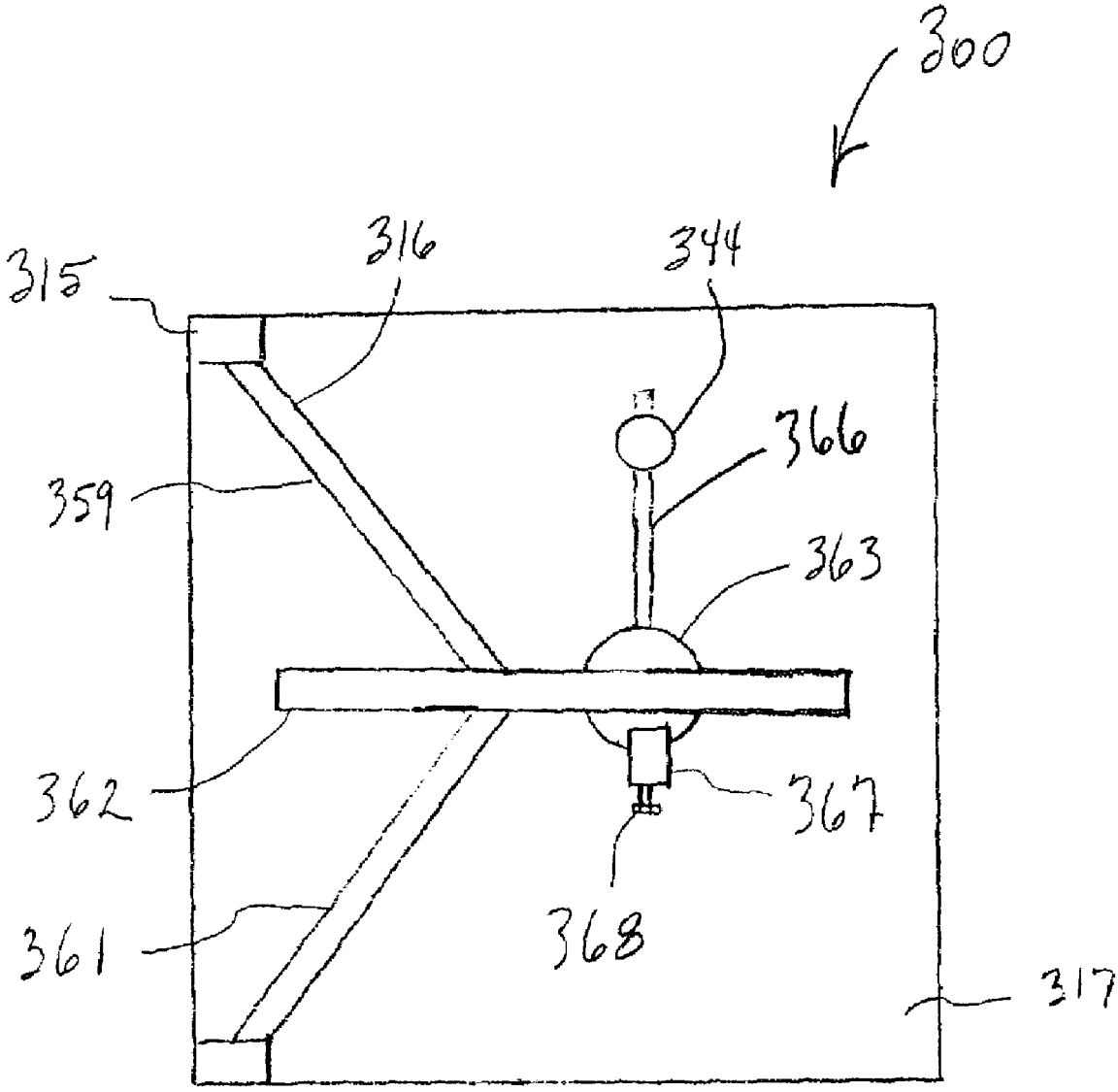
FIG. 10 is a top plan view of FIG. 9.

A third modification of the exercise machine, indicated generally at 300, shown in FIGS. 9 and 10, is a self-contained overhead variable resistance exercise machine useable to exercise and condition the muscle groups to the upper body, such as the abdominal muscles. Exercise machine 300 is suitable for use in an indoor exercise area, such as a gym or fitness center of a hotel, office building, school, condominium complex and the like. The parts of exercise machine 300 that correspond to exercise machine 10 shown in FIGS. 1 to 5 have the same reference number with a prefix 3.

Exercise machine 300 has an upright frame 311 having telescoping tubular upright side support members 312 and 315 which are held together with pins 313 whereby the height of frame 311 is adjustable as desired to operate an overhead rotary resistance member 326 from a standing position or seated position. Support members 312 and 315 extend between a rectangular shaped base 317 and a top frame assembly 316. Base 317 has a generally flat top surface providing an exercise support surface below resistance member 326.

As shown in FIG. 10, top frame assembly 316 has inwardly directed support members 359 and 361 connected to a transverse support member or beam 362. An overhead rotary adjustable resistance member 326 is rotatably mounted on the bottom of beam 362. Resistance member 326 has a disc 363 connected to a downwardly directed link member 364. A laterally extending arm 366 joined to the lower end of link member 364 is used to rotate disc 363. A grip handle 344 extending downwardly from the outer end of arm 366 is gripped by a user and moved in a circular exercise motion to rotate disc 363. Rotation of handle 344 in a forward or backward circular motion turns disc 363. Handle 344 is adapted to be gripped with one hand or both hands or a user.

A brake member 368 mounted on disc 363 has friction material that presses against the sides of disc 363 to provide resistance to rotation of disc 363. Brake member 368 has an adjustment member 369 that is turned to increase or decrease the pressure of the friction material against the sides of disc 363 to increase or decrease the resistance of rotation of disc 363 as desired.

Figure 11:
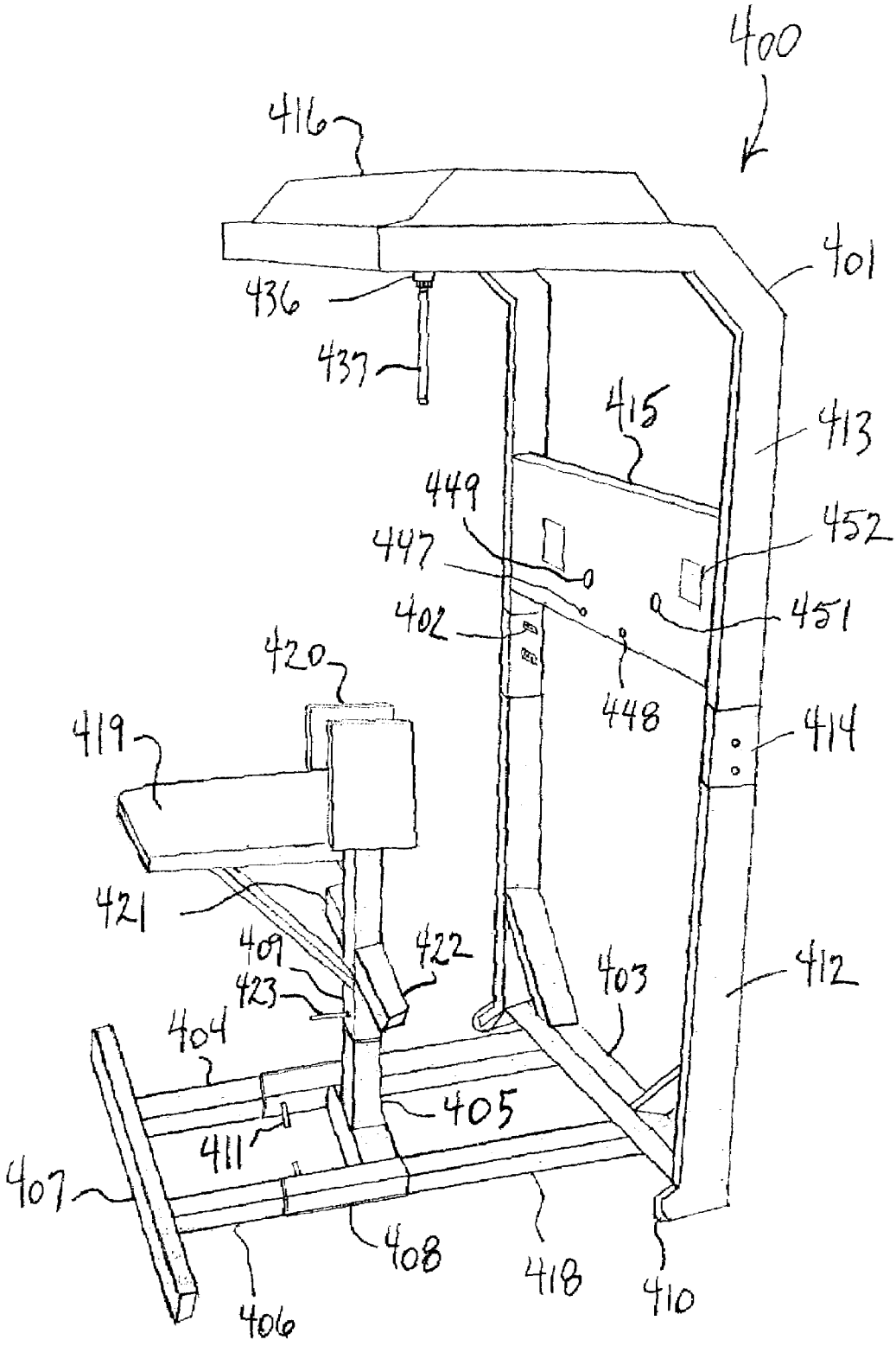
FIG. 11 is a perspective view of a fourth modification of the exercise machine of FIG. 1.
Figure 12:
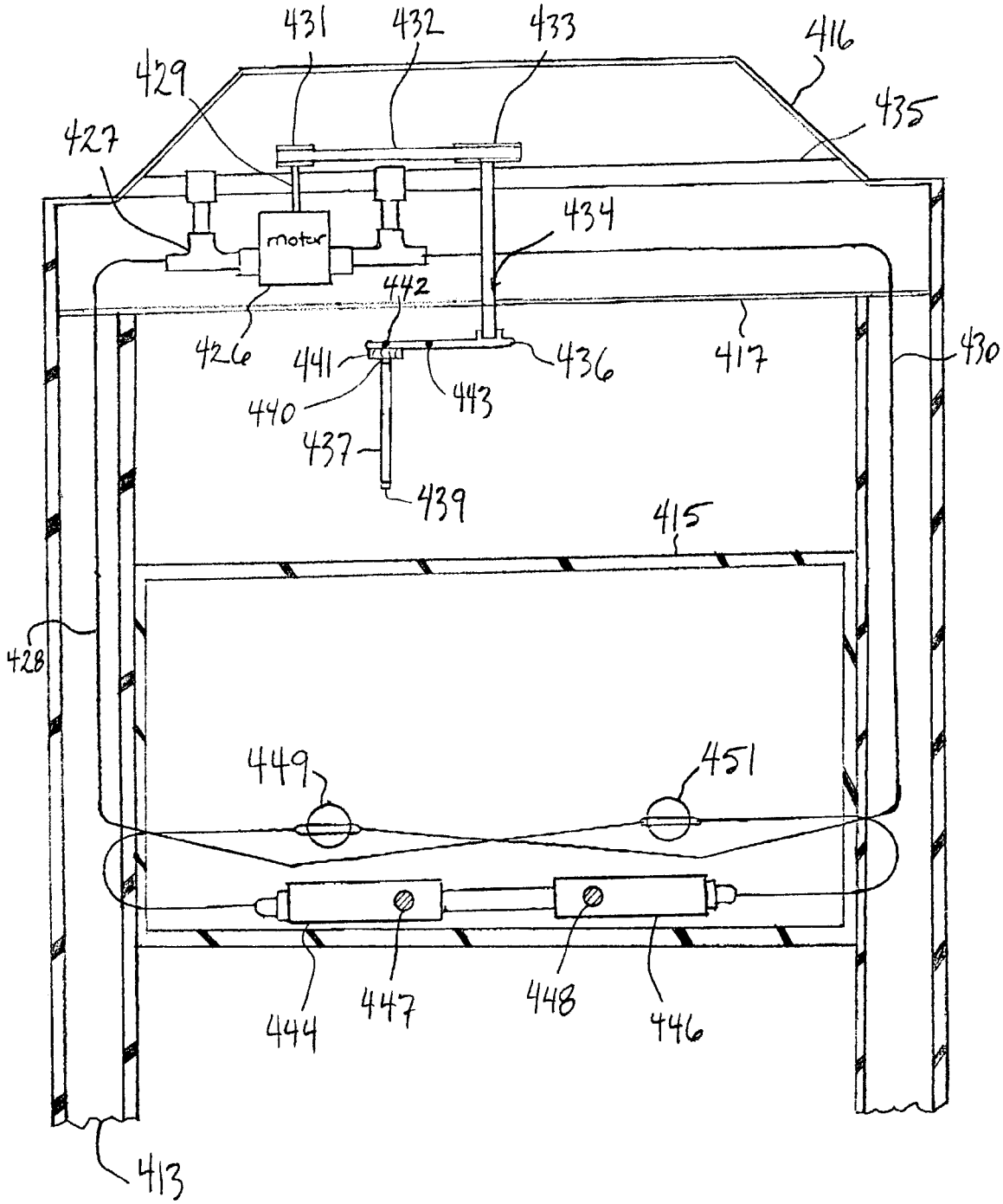
FIG. 12 is an enlarged foreshortened sectional view of the exercise machine of FIG. 11 showing the hydraulic resistance system.

A fourth modification of the overhead adjustable resistance exercise machine, indicated generally at 400, shown in FIGS. 11 and 12, is useable to provide a complete, low impact, and safe upper body workout with an emphasis on strengthening and toning the abdominal and oblique muscle groups. Exercise machine 400 simulates a hammer throw field event in which a weighted metal sphere attached to a flexible handle is rotated overhead and thrown for a distance.

Exercise machine 400 has a generally L-shaped frame 401 with upright upper and lower side members 412 and 413. Support members 412 and 413 are square tubing members having overlapping end sections 414 which are connected with a plurality of fasteners, such as bolts 402. One set of bolts 402 can be removed from support members 412 and 413 to allow upper support member to pivot downwardly to collapse and fold down frame 401 into a more compact shape for transport and storage.

Lower support members 412 extend downwardly and are joined to a transverse generally linear bottom support member 403. A bottom frame assembly 418 has a pair of laterally spaced linear members 404 and 406 attached to a transverse end member 407 and bottom support member 403. Feet 410 stabilize and support exercise machine 400 on the surface of an indoor exercise area, such as a gym, health club and weight room.

A sub-frame assembly 408 slidably mounted on laterally spaced linear members 404 and 406 has an upwardly extending tubular end 405 that telescopes into bottom support 409 attached to bench or seat member 419. Lateral foot rests 421 and 422 extend outwardly from bottom support 409. A pair of thigh pads 420 extend upwardly from opposite forward portions of seat 419. Sub-frame assembly 408 slidably fits over linear members 404 and 406 to allow seat member 419 to be moved forwardly and rearwardly as desired to vary the exercise position between a directly overhead position and a forwardly elevated position. Releasable fasteners, such as pins 411 extending through aligned holes in linear members 404 and 406 and sub-frame assembly 408 hold seat member 419 in its selected transverse position.

Seat member 419 can be adjusted longitudinally to vary the exercise position between an elevated overhead position and an exercise position co-planer with the user's shoulders. The upwardly extending end 405 of sub-frame assembly 408 and downwardly extending bottom support 409 attached to seat member 419 are telescopic members which allow the elevation of seat 419 to be adjusted to vary the longitudinal exercise position as desired. A locking member, such as pin 423 extending through holes in the telescoping portions of end 405 and bottom support 409 maintain the selected elevation of seat 419.

A plate or platform, similar to platform 18 shown in FIG. 1, can be placed over linear members 404 and 406 to allow use of exercise machine 400 from a standing position. The platform slidably fits on members 404 and 406 whereby the platform can be moved forwardly and rearwardly on members 404 and 406.

The top portions of upper support members 413 curve rearwardly generally parallel to bottom frame assembly 418 and are joined to a generally trapezoidal-shaped hood or top member 416. As shown in FIG. 12, top member 416 accommodates a reversible hydraulic motor 426 which is in communication with fluid reservoirs 427 and fluid lines, such as flexible plastic hose or tubing 428 and 430. Motor 426 has a rotatably mounted motor drive shaft 429 coupled to a first pulley 431. A chain or belt 432 driveably connects pulley 431 to a larger second pulley 433. Preferably, pulleys 431 and 433 have a gear ratio of 4:1. Pulleys 431 and 433 can have other size ratios. A pulley drive shaft 434 extending downwardly from pulley 433 through the bottom wall 417 of top member 416 is attached to a transverse movable member or arm 436. A cross beam 435 attached to opposite sides of top member 416 supports shafts 429 and 434.

A grip handle 437 extending downwardly from arm 436 is gripped by a user and moved in a generally circular exercise motion to rotate arm 436. Handle 437 has an outer cylindrical sleeve 438 that is rotatable on bearings 440 surrounding a cylindrical core member 439 releasably attached to arm 436. The upper end of core 439 is moved into the outer end of arm 436 to locate handle 437 in a first exercise position. A fastener, such as knurled adjustment nut 441 on handle 437 is tightened to lock handle 437 on arm 436. When handle 437 is in the first exercise position 442, a user can make relatively large generally circular overhead exercise motions. Handle 437 can be moved to a second exercise position 443 in the middle portion of arm 436 by loosening nut 441 and locating the upper end of core 439 in the middle portion of arm 436 and retightening nut 441. When handle 437 is in the second exercise position, the user can make smaller circular exercise motions.

Fluid lines 428 and 430 are coupled to flow control members 444 and 446 accommodated by a middle panel 415 extending between upper support member 413. Flow control members 444 and 446 each have a knob 447 and 448 projecting through openings in the middle panel 415. Knobs 447 and 448 are rotatable to restrict or liberalize fluid flow rate through fluid control members 444 and 446 to increase or decrease resistance to the movement of arm 436. Flow control member 444 controls flow rate of fluid in lines 428 and 430 when arm 436 is rotated in a clockwise circular motion. Flow control member 446 controls fluid flow rate when arm 436 is rotated in an opposite or counterclockwise direction.

Gauges 449 and 451 accommodated by middle panel 415 are positioned in fluid lines 428 and 430 to sense rates of fluid flow and translate fluid flow rates into readable exercise output data, such as foot-pounds of work done during an exercise motion. Gauges 449 and 451 are visible through openings in middle panel 415 to enable the user to monitor exercise output during a workout. As seen in FIG. 11, indicia plates 452 attached to the outer surface of panel 415 contain information detailing how to use machine 400, positions of use and the like.

In use, the lateral position and elevation of seat member 419 are adjusted relative to bottom frame assembly 418 as desired. When in a seated position on seat 419, a user straddles and squeezes thigh pads 420 with his or her legs, reaches upwardly and/or forwardly, and grips handle 437. The user moves handle 437 in a generally circular overhead motion. This circular motion rotates arm 436 in an elevated generally horizontal plane above bottom frame assembly 418 adjacent the bottom wall 417 of top member 416. Rotation of arm 436 manually drives motor 426 to move fluid through fluid lines 428 and 430 in one direction. Rotation of arm 436 in the opposite direction results in movement of fluid through motor 426 and lines 428 and 430 in the opposite direction. The overhead resistance to rotation of arm can be adjusted by turning knob 447 to vary fluid flow rate when arm rotation is in the clockwise direction and knob 448 when arm rotation is in the counterclockwise direction. The user visually observes gauges 449 and 451 visible through openings in middle panel 415 to determine levels of energy units expended during an exercise regiment.

The present disclosure is preferred embodiments of the overhead adjustable resistance exercise machine. It is understood that the exercise machine is not to be limited to the specific materials, constructions and arrangements shown and described. It is understood that changes in parts, materials, arrangement and locations of structures may be made without departing from the invention.

What is claimed is:

1. An exercise machine for improving shape, tone and strength of the muscles of the human body comprising: a frame having a base joined to one or more upright support members, a top member joined to the upright support members opposite the base, the top member having a movable member elevated above the base, a downwardly extended handle member attached to the movable member, the handle member movable in circular reversible rotational motions to move the movable member in one or more circular rotations, resistance means operatively connected to the movable member providing resistance to movement of the movable member, the resistance means including hydraulic means manually driven by rotation of the movable member, and chair means supported on the base, the chair means slidably mounted on the base to allow the chair means to be horizontally moved between forwardly and rearwardly positions.

2. The machine of claim 1 wherein: the movable member is rotatable in a generally horizontal plane elevated above the base.

3. The machine of claim 1 wherein: the hydraulic means includes a fluid control member to adjust fluid flow rate through the hydraulic means and adjust the resistance to rotation of the movable member.

4. The machine of claim 3 including: a second fluid control member to adjust fluid flow rate through the hydraulic means independent from the first fluid control member to increase or decrease resistance to the movement of the movable member.

5. An exercise machine for improving shape, tone and strength of the muscles of the human body comprising: a frame having a base joined to one or more upright support members, a top member joined to the upright support members opposite the base, the top member having a movable member elevated above the base, a downwardly extended handle member attached to the movable member, the handle member movable to move the movable member, means providing resistance to movement of the movable member operatively connected to the movable member, the means providing resistance to movement of the moveable member including a hydraulic motor operated by rotation of the movable member a fluid line in communication with the hydraulic motor and indicator means located in the fluid line operable to sense the rate of fluid flow through the line and translate the fluid flow rate into readable exercise data.

6. An exercise machine for improving shape, tone and strength of the muscles of the human body comprising: a frame having a base joined to one or more upright support members, a top member joined to the upright support members opposite the base, the top member having a movable member elevated above the base, a downwardly extended handle member attached to the movable member, the handle member movable to move the movable member, means providing resistance to movement of the movable member operatively connected to the movable member, the means providing resistance to movement of the movable member including a hydraulic motor operated by movement of the movable member a fluid line in communication with the hydraulic motor and a fluid control member coupled to the fluid line operable to adjust fluid flow rate through the line thereby adjusting the resistance to movement of the moveable member.

7. The machine of claim 6 including: platform means removably mounted on the base.

8. The machine of claim 6 wherein: the upright support members have overlapping end sections, fastener means connecting the end sections, the fastener means removable from the end sections to allow the support members to pivot and collapse the frame to facilitate storage and transport.

9. The machine of claim 6 including: chair means supported on the base.

10. The machine of claim 9 wherein: the chair means is slidably mounted on the base to adjust the horizontal position of the chair means relative to the handle member, the chair means including a seat member adjustable in height.

11. An exercise machine for the upper body comprising: a L-shaped frame having an upper support member releasably attached to a bottom support member, a top member joined to the upper support member, a transverse arm rotatably mounted on the top member, a downwardly extending handle member attached to the arm and movable in circular reversible rotations to move the arm in one or more circular rotations in an elevated generally horizontal plane, a reversible hydraulic motor operably connected to the arm and manually driven by rotation of the arm, a first fluid line in communication with the motor, a first fluid control member coupled to the first fluid line to adjust fluid flow rate through the first line when the arm is moved in circular clockwise rotations and adjust the resistance to the clockwise rotations of the arm, a first indicator located in the first fluid line operable to sense the rate of fluid flow through the first line and translate the fluid flow rate into readable data, a second fluid line in communication with the motor, a second fluid control member coupled to the second fluid line to adjust fluid flow rate through the second line when the arm is moved in circular counterclockwise rotations and adjust the resistance to counterclockwise rotations of the arm independent from adjustment of resistance to clockwise rotations of the arm, a second indicator located in the second fluid line operable to sense the rate of fluid flow through the second line and translate the fluid flow rate into readable data.

12. The machine of claim 11 wherein: the upper support member and the bottom support member have overlapping end sections, fastener means connecting the end sections, the fastener means removable from the end sections to allow the upper support member and bottom support member to pivot and collapse the frame to facilitate storage and transport.

13. The machine of claim 11 wherein: the handle member is releasably attachable to one or more portions of the arm to vary the size of the circular rotations of the handle member.

14. A method for improving shape, tone and strength of the muscles of the human body using an exercise machine having support means, and a moveable member moveably mounted on the support means for circular rotation, handle means attached to the moveable member, comprising: locating the moveable member in an elevated generally horizontal plane, moving the moveable member in successive circular rotations by moving the handle means in a plurality of circular rotational motions, operatively connecting hydraulic means to the moveable member, the hydraulic means operated by movement of the moveable member, the hydraulic means including at least one fluid control member operable to adjust fluid flow rate through the hydraulic means and vary the resistance to movement of the moveable member as desired.

15. The method of claim 14 including: chair means mounted on the support means, the chair means slidably mounted on the support means to adjust the horizontal position of the chair means relative to the handle means, the chair means including a seat member adjustable in height.

16. The method of claim 14 including: moving the movable member in successive circular rotations in an opposite direction by moving the handle means in opposite circular rotational motions.

17. The method of claim 16 including: a second fluid control member to adjust fluid flow rate through the hydraulic means and vary the resistance to the movement of the moveable member independently from the first fluid control member when the handle means is moved in the opposite circular rotational motions.

18. An exercise device comprising: a handle member being positioned generally at or above a user's shoulders when the user exercises on the device, the handle member being capable of 360 degree reversible rotational motion relative to the user, the motion being substantially confined to a closed plane curve parallel to a surface on which the device is supported wherein the motion is controlled via a closed loop hydraulic system powered by the user, the hydraulic system operable to variably resist the rotational motion of the handle member.

19. The exercise device of claim 18 wherein: the radius of the motion is capable of being increased or decreased.

* * * * *